United States Patent [19]

Kivimaa

[11] 4,263,949

[45] Apr. 28, 1981

[54] CUTTER HEAD

[76] Inventor: Eero M. Kivimaa, Linnankoskenkatu 15 A, 00250 Helsinki 25, Finland

[21] Appl. No.: 960,796

[22] Filed: Nov. 14, 1978

[30] Foreign Application Priority Data

Nov. 24, 1977 [FI] Finland ..... 773565
Apr. 10, 1978 [FI] Finland ..... 783024

[51] Int. Cl.[3] ..... B27G 13/04; B27L 11/02

[52] U.S. Cl. ..... 144/235; 144/176; 144/220; 407/31

[58] Field of Search ..... 144/38, 39, 162 R, 176, 144/218, 220, 231, 235, 236, 237, 326 R; 241/293; 407/31

[56] References Cited

U.S. PATENT DOCUMENTS

| | | | |
|---|---|---|---|
| 1,472,960 | 11/1923 | Conklin | 144/235 |
| 3,330,315 | 7/1967 | Tomlinson | 144/162 R X |
| 3,346,028 | 10/1967 | Milten | 144/220 X |
| 3,487,865 | 1/1970 | Chapman et al. | 144/162 R X |
| 3,645,308 | 2/1972 | Nilsson | 144/176 |
| 3,780,778 | 12/1973 | Chapman | 144/162 R X |
| 3,872,902 | 3/1975 | Nilsson | 144/162 R |
| 3,986,543 | 10/1976 | Slayton et al. | 144/236 |
| 4,147,193 | 4/1979 | Kivimaa | 144/162 R |

*Primary Examiner*—W. Donald Bray
*Attorney, Agent, or Firm*—Ladas & Parry

[57] ABSTRACT

Cutter head especially for a canter-chipper or chipper-edger comprising a body mounted on a shaft of rotation and cutting knives fastened on the body. The cutting knives form parallel cutting paths. The cutting knives in the cutting paths next to the log having a cutting width of about 8–25% of the total cutting width of the cutter head are mounted on an easily removable ring facilitating the replacement of these swiftly wearing cutting knives.

6 Claims, 8 Drawing Figures

CUTTER HEAD

Figure 1:
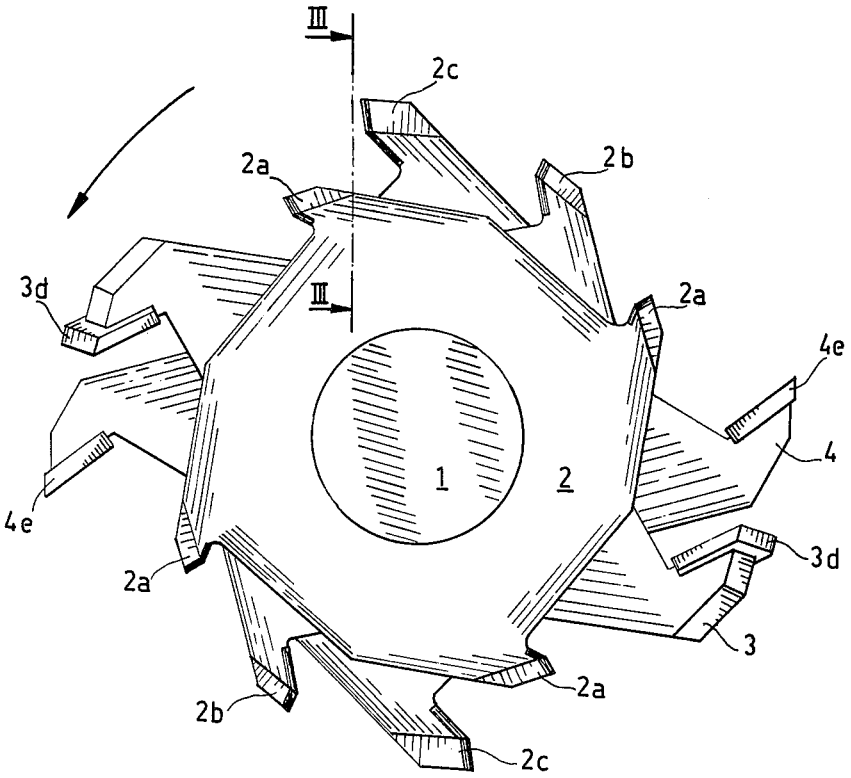

This invention relates to a cutter head, for example, for a canter-chipper or chipper-edger. A known cutter head comprises a rotary shaft disposed, substantially perpendicular to the direction of feed of the log, a body mounted on the rotary shaft and cutting knives fastened on the body and arranged to form a few parallel cutting strips. The diameters of the cutting circles defined by the knives forming the different strips, increase in the direction away from the log to be treated, and the knives are arranged stepwise one after the other so that the cutting knives in each outer cutting path having a larger diameter always cut before the cutting knives in the next inner cutting path.

By means of such cutter heads, canter-chippers cut the slabs of logs and chipper-edgers cut the edge portions of boards straight into chips.

The present cutter head construction is the result of both practical and laboratory studies performed during a number of years and of discoveries made in the course of these studies.

In the very initial stage of the studies, which at that time were concentrated on the cutting force of the knives, it was found to be expedient to divide the cutting width of the cutter head into a few parallel cutting strips in the manner described above. The operation of such a cutter head is smooth and the log is fairly easy to guide, especially when the knives cut across the entire width of the cutter head.

Similarly, it was in the very beginning found to be expedient to use only an open cutting where the chips are freely discharged as soon as they are formed.

When studying the dependence of the chip quality on various factors the angle of inclination of the knife proved to be of central significance. The angle of inclination (k) in this case refers to the angle between the main cutting edge of the knife, cutting through the wood grains, or the projection of said edge in a plane passing through the axis of rotation of the cutter head, and the axis of the cutter head.

A large angle of inclination, about 55° to 70°, proved to be very advantageous. In this case, the proportion of less valuable chipping fines to be screened off is small and the ends of the chips are practically undamaged. Also the thickness distribution of the chips is generally good. However, if the industry using chips has a definite requirement as to the thickness, for example, maximum 5 mm, this requirement can be satisfied by selecting a width of 5 mm for the cutting strips.

In practice, in addition to the chip quality, ever higher requirements are also made on the smoothness of the surface cut by the cutter head which should be first-class also at the knots. In extensive studies concerning this problem, a large angle of inclination of the knife again proved to be advantageous. The quality of the surface is decisively improved also in difficult cases if, additionally, the number of the knives located closest to the log, i.e. the number of finishing knives is increased. If, for example, the number of knives in the other cutting in the cutter head is 2 and the number of revolutions of the cutter head and the feed speed of the log are selected so that the length of chips (l) in the direction of grains is 24 mm, the number of knives in the finishing strip may be selected to be, e.g., 4, 6 or 8. The length of the chips obtained in the finishing strip is then correspondingly l = 12, 8 or 6 mm. Also in the last mentioned case (l = 6 mm), the flakes are still usable chips and not less valuable sawdust which is obtained if a circular saw blade is used as finishing tool. The surface quality is further improved if the width of the finishing strip is reduced. However, the limitation is that the finishing knives should remove the recesses left by the knives cutting longer chips in the preceding cutting strip.

The practical application of the results obtained was, however, hampered by the fact that a large angle of inclination results in a large outer diameter in the cutter head and narrow cutting paths involve a large number of knives, which facts with regard to the construction of the machine and the service of the cutter head are undesirable. A successful solution to these problems was, however, found in the unexpected discovery that practically the entire chipping is actually carried out in a very narrow zone of the cutter head which faces the log and which can be called the cutting zone proper. The main part of the cutting width of the cutter head, on the other hand, functions as a reserve zone which in itself is necessary because of butt expansions occasionally occurring in logs and because of possible incorrect guiding of the log, the wood quantity chipped by said zone, however, being so small that it has nearly no effect on the average quality of chips.

This led to the cutter head construction described already earlier by the applicant (U.S. Patent No. 4,147,193), in which a large angle of inclination of the main cutting edge of the knives and, if necessary, narrow cutting strips are used only in the cutting zone proper and a small angle of inclination and relatively wide cutting strips are used in the reserve zone. On the other hand, in such a cutter head of a small diameter such a large number of revolutions can be used that even when aiming at a high feed speed seldom more than two knives are needed in the same cutting zone. However, in the finishing strip closest to the log it is expedient to use four or six knives depending on the wood quality and on the requirements made on the surface smoothness. It has been found that an advantageous number of cutting strips in the narrow cutting zone proper is 2 to 5 and very expediently 3 and in the wide reserve zone 1 to 3, expediently 2.

Although the described cutter head construction has proved to be very useful in practice, further studies related to the cutter head led to new and even more important discoveries concerning the improvement of the cutter head construction. The division of the cutting width of the cutter head into a cutting zone proper and a reserve zone soon proved to be of a deeper significance than described above. Additional advantages are obtained by shaping the cutter head such that all the knives in the inner cutting strips which are located in the cutting zone proper closest to the log and the width whereof is about 8 to 25 percent, preferably about 15 percent, of the total cutting width are mounted on a disc or ring fastened in easily removable manner on the body supporting the cutting knives in the outer cutting strips. By fastening the knives in the cutting zone proper on a replaceable cutting disc or cutting ring easily removable from the remaining cutter head, the service of the cutter head will be simple and easy and interruptions in the production due to sharpening of the knives or possible knife damage will be very short. The knives in the cutting zone proper which are sujected to the hardest wear can now be replaced for sharpening outside the machine and only a few knives with a minor cutting function in the reserve zone must be changed in the machine itself.

In addition, an entirely new, unexpected advantage which in practice is of a decisive importance appeared to be the possibility to use in each machining case a cutting ring best suitable for the desired chip quality or the surface smoothness. By changing the cutting ring performing nearly the entire chipping practically the same effect is obtained as by the reconstruction and cumbersome replacement of the entire expensive cutter head.

Despite the fact that this cutter head construction now seemed to be "ready," it could still be decisively improved continued research work and a new discovery forming an embodiment of the invention. Although the cutting forces stressing the knives are quite small, unexpectedly great stresses may in case of any disturbance be applied on the knives, said stresses having a tendency to bend and break especially the narrow finishing knives. Moreover, slivers tend to penetrate into the fastening points of the knives in spite of the free discharge of the chips. These are difficulties occurring in practice in nearly all cutter heads, especially in those cases where a removable circular saw blade or blade segments are used instead of finishing knives. In the present case, both difficulties could be entirely eliminated when recognizing that removable separate knives could be omitted in the cutting ring of the cutting zone proper and that the cutting ring and the knives or "teeth" therein could be made integral. As all knives are wider than their cutting strip, no bending of the knives can occur. The wide "gullets," on the other hand, completely prevent the clogging of the cutting ring or the sticking of slivers to the knives. In principle, the one-piece cutting ring can be made entirely of hardened steel, but it is even more appropriate to make the cutting ring and the knives therein, for example, of tough constructional steel and to use hardened high speed steel, tungsten carbide or any other cutting material in a mannerknown as cutting bits in the actual cutting portion of the knives only. The cutting portion can also be formed by welding, e.g., of stellite.

As it is, the cutting disc or cutting ring of the present invention is distinct and simple in construction, economical to manufacture and easy to maintain.

In addition, cutting rings best suited for various applications are simply made at low costs, and also the total cutting width of these rings may vary.

Figure 2:
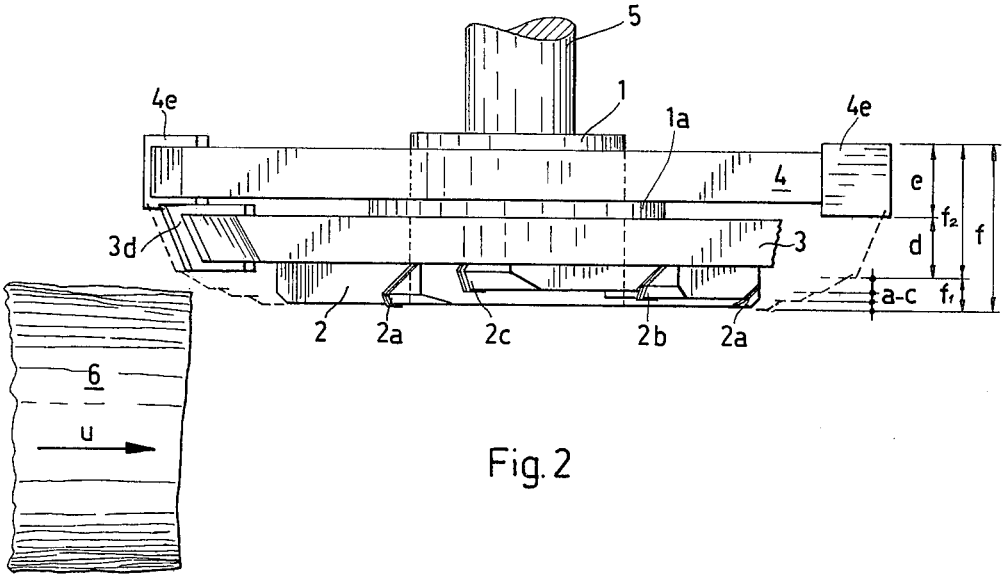
Figure 5:
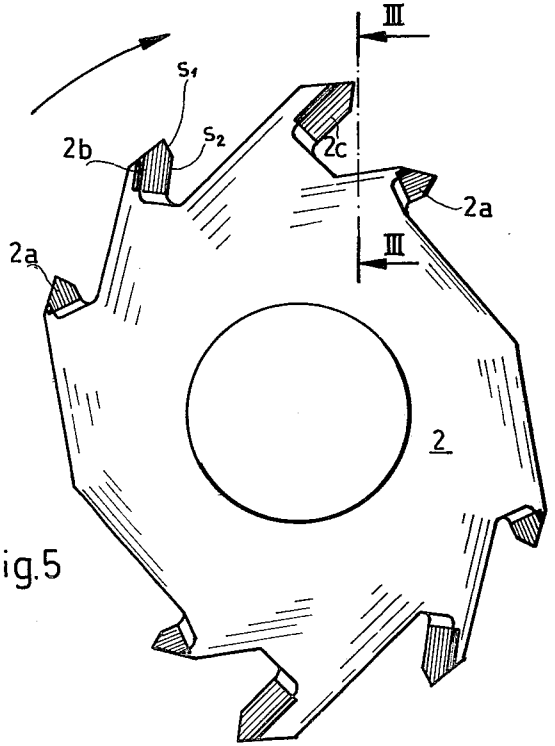
Figure 3:
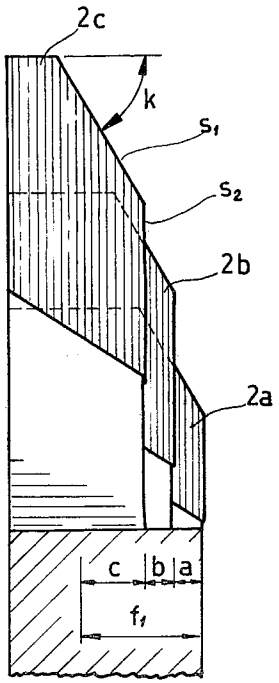
Figure 4:
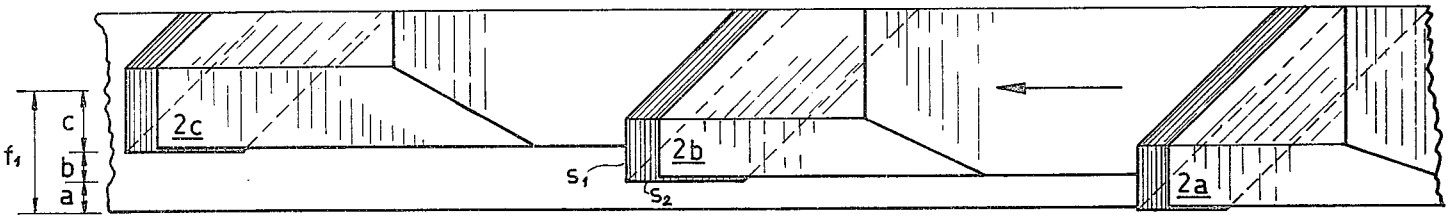
Figure 7:
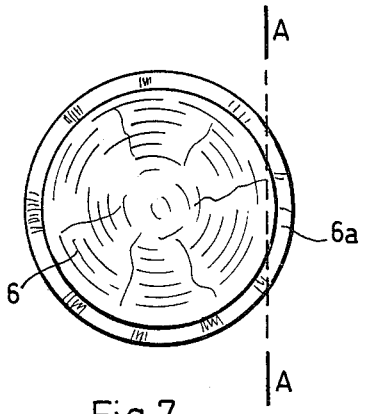
Figure 6:
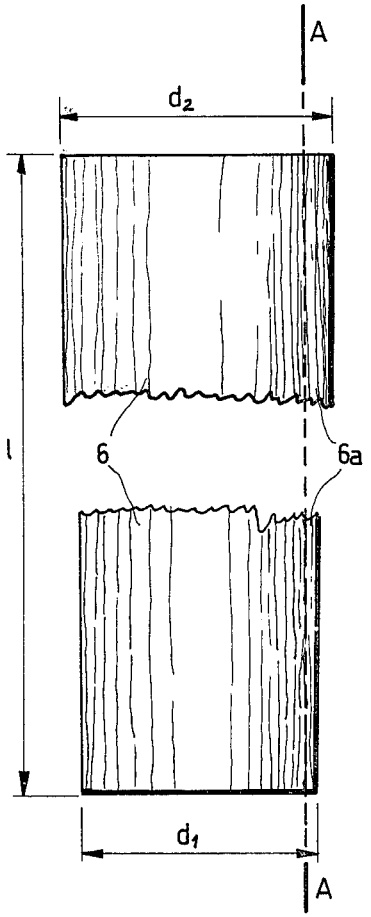
Figure 8:
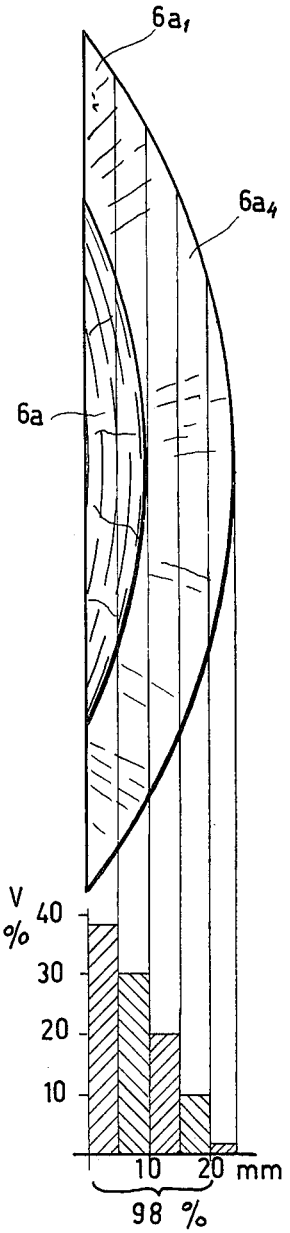

One preferred embodiment of the cutter head according to the invention will now be described in more detail by means of numerical examples and with reference to the accompanying drawings, in which FIG. 1 is a schematic view of a left-hand cutter head, when viewed in the feeding direction of the log and from the side of the log, FIG. 2 is a top view of the cutter head, FIG. 3 is a section along line III—III in FIGS. 1 and 5 of one knife in the cutting zone proper, when viewed in the feeding direction of the log. The ring is further thought to be aligned in the horizontal plane, whereby also the next two knives are visible in the background, FIG. 4 is a top view of the same point in the aligned ring as in FIG. 3 and of the knives therein, FIG. 5 is a view of the cutting ring removed from the cuter head, when viewed from the opposite side as compared to FIG. 1, FIG. 6 is a top view of a log to be canted, FIG. 7 illustrates the same log, when viewed from the top end, FIG. 8 is a top end view of a slab to be chipped off along line A—A from the log shown in the preceding Figures.

In the Figures, reference numeral 1 denotes the body of a cutter head and *1a* a central flange provided therein. Numeral 2 indicates a cutting ring in the cutting zone proper, said ring being provided with four finishing knives 2*a* and two knives 2*b* and 2*c*. Numerals 3*d* and 4*e* denote the knives in the reserve zone which are in a suitable manner fastened on corresponding knife arms 3 and 4. The number of finishing knives 2*a* is thus in this case twice the number of the other knives and they, accordingly, cut chips half as long as the chips cut by the other knives, e.g., of a length of 12 mm, if the length of chips cut by the other knives in that direction is 24 mm in the direction of the grain.

The cutter head is assembled, e.g., by means of bolts (not shown in the Figures) passing through the knife arms 3 and 4 as well as the flange 1*a*. The cutting ring 2 is, on the other hand, fastened in easily removable manner to this combination by means of other bolts.

Numeral 6 denotes a log fed at a speed u toward the cutter head. Numeral 5 indicates the shaft on the cutter head arranged essentially perpendicularly to the direction of feed u and movable in the axial direction.

As is clearly seen from FIGS. 1 to 5, the cutting ring 2 is made integral with its knives or "teeth" 2*a*, 2*b* and 2*c*. The actual cutting portions of the knives are shown shadowed in the Figures and are comprised of cutting bits fastened on the knives, for example, by soldering.

In the Figures, $S_1$ denotes the main cutting edge which actually cuts wood fibers, $S_2$ denotes the finishing edge parallel to the cutting plane and serving to remove the cut fibers from the log, and k denotes the angle of inclination of the main cutting edge $S_1$.

FIGS. 3 and 4 illustrating the stepped arrangement of the cutting knives 2*c* and 2*b* and the finishing knife 2*a* in the radial and axial direction, respectively, of the cutter head and additionally show the cutting strips of the knives. The widths of the strips a and b is in this case 5 mm, that of the cutting strip c 10 mm and, accordingly the width of the entire cutting zone proper $f_1$ 20 mm. The knives themselves are wider than their cutting strips.

In the illustrated example of the invention, the total cutting width f of the cutter head is 130 mm and the width of the reserve zone $f_2$, accordingly, 110 mm and that of each of its cutting strips d and e 55 mm.

The advantageousness of such a construction is supported by extensive computer calculations, whereof FIGS. 6 to 8 illustrate one representative arithmetical example in which, by means of the relatively narrow (f=130 mm) cutter head described above, an average slab 6*a* is cut from a log 6 of average conicity. In the computer study, the log having a length l=4500 mm, was regarded as a mathematical truncated cone having a top diameter $d_1=200$ and a butt diameter $d_2=230$ mm. If the thickness of the slab 6*a* to be cut off at the top is 10 mm and at the butt, accordingly, 25 mm, this slab represents about 4.5 percent of the total log volume.

FIG. 8 additionally shows the percentile distribution of the volume V of the slab 6*a* on 5 mm thick lamellas, whereby four lamellas $6a_1$ to $6a_4$ on the side of the log represents in all 98 percent of the entire slab volume. Accordingly, the share to be cut by the reserve zone would in this case be only 2 percent of the slab volume V. In this case, the width of 20 mm used in the cutting zone proper $f_1$ is quite sufficient and amounts to only 15.4 percent of the total cutting width f = 130 mm of the cutter head.

The cutting width $f_1$ of the cutting zone proper, which also is the cutting width of the removable cutting ring, and the cutting width f of the entire cutter head as well as the mutual relation between these widths may, of course, vary from case to case depending on the application of the cutter head. If, for example, in canting only 90 percent of the slab volume V to be chipped is to be cut off by means of the removable cutting ring, the cutting ring will be relatively narrow and lightweight. On the other hand, it may be appropriate to use, for example, in a smaller cutter head used in edging a somewhat wider cutting ring.

The cutting width $f_1$ of the cutting ring is, however, always only a fraction, about 8 to 25 percent, of the total cutting width f of the cutter head. The width $f_1$ used in the above described example and amounting to about 15 percent of the total cutting width f of the cutter head is likely to be very advantageous in most cases and said 15 percent, accordingly, very well describes the magnitude of the cutting width of the cutting ring.

What I claim is:

1. A cutter head, for example for a canter-chipper or a chipper-edger, comprising a shaft having a central axis, which shaft can be mounted to rotate about said central axis with said central axis disposed substantially perpendicular to the direction of feed of a length of timber to be cut, and at least two sets of cutting knives defining respective cutting circles the diameters of which increase in the direction away from the length of timber along said central axis, the entire cutting width of the cutter head, measured in a direction parallel to said central axis, thereby being divided into parallel cutting strips defined by said sets of knives, and the knives of each two adjacent sets, defining smaller and larger cutting circles respectively, being staggered one after the other so that a knife of the set defining the larger cutting circle always cuts before a knife of the set defining the smaller cutting circle, and wherein at least one set of knives, including the set defining the smallest cutting circle, defines the cutting zone proper of the cutter head, the width of which zone is from about 8 percent to about 25 percent of the total cutting width of the cutter head, and the cutter head further comprises a body mounted on the shaft and to which the knives of at least one set other than the said at least one set defining the cutting zone proper are secured, and a disc or ring secured to said body in easily removable manner and upon which the knives of the said at least one set defining the cutting zone proper are mounted.

2. A cutter head as claimed in claim 1, wherein the width of the cutting zone proper is about 15 percent of the total cutting width of the cutter head.

3. A cutter head as claimed in claim 1, wherein the knives mounted upon the disc or ring are integral therewith.

4. A cutter head as claimed in claim 1, 2 or 3, wherein the knives of at least one set include cutting bits which are fastened to the knives.

5. A cutter head as claimed in claim 1, wherein the number of sets of knives defining the cutting zone proper is from 2 to 5 and the number of other sets of knives is from 1 to 3.

6. A cutter head as claimed in claim 1 or 5, wherein the number of sets of knives defining the cutting zone proper is 3 and the number of other sets of knives is 2.

* * * * *